US010181679B1

(12) United States Patent
Probert et al.

(10) Patent No.: US 10,181,679 B1
(45) Date of Patent: Jan. 15, 2019

(54) ELECTRICAL CONNECTOR WITH TERMINAL POSITION ASSURANCE

(71) Applicant: Lear Corporation, Southfield, MI (US)

(72) Inventors: Deborah Probert, Farmington Hills, MI (US); Reinhard Pusch, Farmington Hills, MI (US); David Menzies, Linden, MI (US); Bhupinder Rangi, Novi, MI (US); Michael Glick, Farmington Hills, MI (US); Yasin Canol, Remscheid (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/789,378

(22) Filed: Oct. 20, 2017

(51) Int. Cl.
*H01R 13/629* (2006.01)
*H01R 13/502* (2006.01)

(52) U.S. Cl.
CPC ..... *H01R 13/6295* (2013.01); *H01R 13/502* (2013.01); *H01R 13/62938* (2013.01); *H01R 13/62955* (2013.01); *H01R 13/62966* (2013.01); *H01R 2201/26* (2013.01)

(58) Field of Classification Search
CPC ..... H01R 13/6295; H01R 13/502; H01R 13/62938
USPC ..... 439/372
See application file for complete search history.

(56) References Cited

U.S. PATENT DOCUMENTS 4,557,542 A 12/1985 Coller et al.
4,959,023 A 9/1990 Watanabe et al.
5,085,599 A * 2/1992 Maejima ..... H01R 13/4365 439/595
5,871,373 A * 2/1999 Pacini ..... H01R 13/4364 439/364
5,879,180 A * 3/1999 Iwahori ..... H01R 13/641 439/352
5,967,859 A * 10/1999 Cecil, Jr. ..... H01R 13/4368 439/595
6,132,252 A * 10/2000 Chaillot ..... H01R 13/4365 439/595
6,179,671 B1 * 1/2001 Ohsumi ..... H01R 13/4364 439/595
6,305,990 B1 10/2001 Ward
6,375,502 B2 * 4/2002 Yoshida ..... H01R 13/4223 439/595

(Continued)

FOREIGN PATENT DOCUMENTS

EP 0443492 A1 8/1991

*Primary Examiner* — Alexander Gilman
(74) *Attorney, Agent, or Firm* — MacMillan, Sobanski & Todd, LLC

(57) ABSTRACT

An electrical connector includes a first housing with a plurality of first terminal slots. Each first terminal slot includes a first terminal lock. Each first terminal slot also includes a first end stop. The first end stops are part of the first housing. Each first terminal slot is configured to retain a first electrical terminal between the first terminal lock and the first end stop. The electrical connector also includes a first terminal position assurance. The first terminal position assurance includes a first terminal position assurance body. A plurality of first lock retainers extend from the first terminal position assurance body. The first lock retainers prevent the first terminal locks from moving to a release position. The first terminal position assurance body is located in the same plane as the first end stops.

18 Claims, 19 Drawing Sheets

(56) References Cited

U.S. PATENT DOCUMENTS

| | | | | |
|---|---|---|---|---|
| 6,558,176 | B1 * | 5/2003 | Martin | H01R 13/62944 439/157 |
| 6,607,407 | B2 * | 8/2003 | Takatsuki | H01R 13/4365 439/271 |
| 6,749,469 | B2 * | 6/2004 | Matsuoka | H01R 13/62911 439/752 |
| 6,913,494 | B2 | 7/2005 | Ward et al. | |
| 7,175,483 | B2 * | 2/2007 | Ishikawa | H01R 13/4362 439/752 |
| 7,182,652 | B2 * | 2/2007 | Yamakado | H01R 13/4362 439/752 |
| 7,207,848 | B2 * | 4/2007 | Fukatsu | H01R 13/4362 439/157 |
| 7,278,890 | B1 * | 10/2007 | Smutny | H01R 13/4361 439/752 |
| 7,500,875 | B2 * | 3/2009 | Lamdiziz | H01R 13/4223 439/595 |
| 7,775,831 | B2 * | 8/2010 | Mase | H01R 13/4362 439/595 |
| 8,210,864 | B1 | 7/2012 | Hernandez et al. | |
| 8,348,703 | B2 | 1/2013 | De Blieck et al. | |
| 8,376,778 | B2 * | 2/2013 | Obata | H01R 13/4223 439/595 |
| 8,408,950 | B2 * | 4/2013 | Jeon | H01R 13/4365 439/595 |
| 8,435,085 | B2 | 5/2013 | De Blieck et al. | |
| 8,550,845 | B1 * | 10/2013 | Osterhart | H01R 13/4365 439/595 |
| 9,054,454 | B2 * | 6/2015 | Gomez | H01R 13/631 |
| 9,281,614 | B1 * | 3/2016 | Bonucci | H01R 13/62927 |
| 9,935,389 | B1 * | 4/2018 | Irish | H01R 13/4223 |
| 2006/0172612 | A1 * | 8/2006 | Wasalaski | H01R 13/447 439/752 |

* cited by examiner

ELECTRICAL CONNECTOR WITH TERMINAL POSITION ASSURANCE

BACKGROUND OF THE INVENTION

This invention relates to an electrical connector with a terminal position assurance. More specifically, this invention relates to an electrical connector with a terminal position assurance including features that allow for additional connector features without increasing the size of the electrical connector or the terminal position assurance.

Vehicles, such as passenger cars include an increasing number of electrical devices. Features such as lights, cameras, sensors, motors, blowers, and heaters are used to provide comfort or safety features for passengers of the vehicles. In order to operate these electronic components, electrical connections are provided in the vehicle to transfer operating power and control signals. During assembly of a vehicle, the components are typically put in position and multiple wires are run together in a wire harness. Each of the individual wires can be connected to a separate electrical terminal. Multiple electrical terminals may be placed in a connector, which is mated with a corresponding connector in order to make electrical connections to all the wires in the wire harness simultaneously. Connecting multiple terminals simultaneously increases the amount of force an operator has to exert to mate the connectors, and in order to remove the need for the operator to use a separate tool, it is known to use lever actuated connectors such as the one described in U.S. Pat. No. 9,281,614.

In order to confirm that the electrical terminals are in the proper positions in the connector housings during assembly and mating, electrical connectors often include terminal position assurance components. An example of a connector that includes a terminal position assurance is shown in U.S. Pat. No. 6,913,494. The '494 patent shows a connector that has multiple recesses to accommodate electrical terminals and a finger in each recess engages the terminal in that recess. The connector includes an end-type terminal position assurance with a body that extends across the outer ends of the recesses. The terminal position assurance includes members that extend into each recess in order to hold the finger in place against the terminal. Each terminal is then retained in position in the respective recess, trapped between the finger and the body of the terminal position assurance. The '494 patent shows a similar end-type terminal position assurance on both the male connector and the female connector, and when the two connectors are mated the two terminal position assurances are adjacent to each other with respective outer faces engaged. The end-type terminal position assurance is advantageous in that it has access to each of the terminal recesses from a single body and also does not require any additional openings through the connector housing.

As the number of electrical components in vehicles continues to increase, there is a desire to fit an increasing number of electrical connections in the vehicles. As a result, it would be advantageous to have an electrical connector which allows a greater number of electrical terminals to be fit in a location, while still being easy for the operator to use.

SUMMARY OF THE INVENTION

This invention relates to an electrical connector. The electrical connector includes a first housing. The first housing includes a plurality of first terminal slots. Each first terminal slot includes a first terminal lock. Each first terminal slot also includes a first end stop. The first end stops are part of the first housing. Each first terminal slot is configured to retain a first electrical terminal between the first terminal lock and the first end stop. The electrical connector also includes a first terminal position assurance. The first terminal position assurance includes a first terminal position assurance body. A plurality of first lock retainers extend from the first terminal position assurance body. The first lock retainers prevent the first terminal locks from moving to a release position. The first terminal position assurance body is located in the same plane as the first end stops.

In another embodiment, the electrical connector also includes a second housing. The second housing includes a plurality of second terminal slots. Each second terminal slot includes a second terminal lock. Each second terminal slot also includes a second end stop. The second end stops are part of the second housing. Each second terminal slot is configured to retain a second electrical terminal between the second terminal lock and the second end stop. The electrical connector also includes a second terminal position assurance. The second terminal position assurance includes a second terminal position assurance body. A plurality of second lock retainers extend from the second terminal position assurance body. The second lock retainers prevent the second terminal locks from moving to a release position. The second terminal position assurance body is located in the same plane as the second end stops. The second housing is located in a seated position relative to the first housing wherein a front face of the first terminal position assurance is engaged with a front face of the second terminal position assurance.

Another embodiment of the invention relates to an electrical connector. The electrical connector includes a first housing including a plurality of first terminal slots. Each first terminal slot includes a first terminal lock and a first end stop that is a part of the first housing. Each first terminal slot is configured to retain a first electrical terminal between the first terminal lock and the first end stop. The electrical connector also includes a first terminal position assurance that includes a first terminal position assurance body and a plurality of first lock retainers that extend from the first terminal position assurance body and prevent the first terminal locks from moving to a release position. The first terminal position assurance body includes a plurality of first cut outs. The first end stops are located in the first cut outs. The electrical connector includes a second housing including a plurality of second terminal slots. Each second terminal slot includes a second terminal lock and a second end stop that is a part of the second housing. Each second terminal slot is configured to retain a second electrical terminal between the second terminal lock and the second end stop. The electrical connector also includes a second terminal position assurance that includes a second terminal position assurance body and a plurality of second lock retainers that extend from the second terminal position assurance body and prevent the second terminal locks from moving to a release position. The second terminal position assurance body includes a plurality of second cut outs. The second end stops are located in the second cut outs. The second housing located in a seated position relative to the first housing wherein a front face of the first terminal position assurance is engaged with a front face of the second terminal position assurance.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
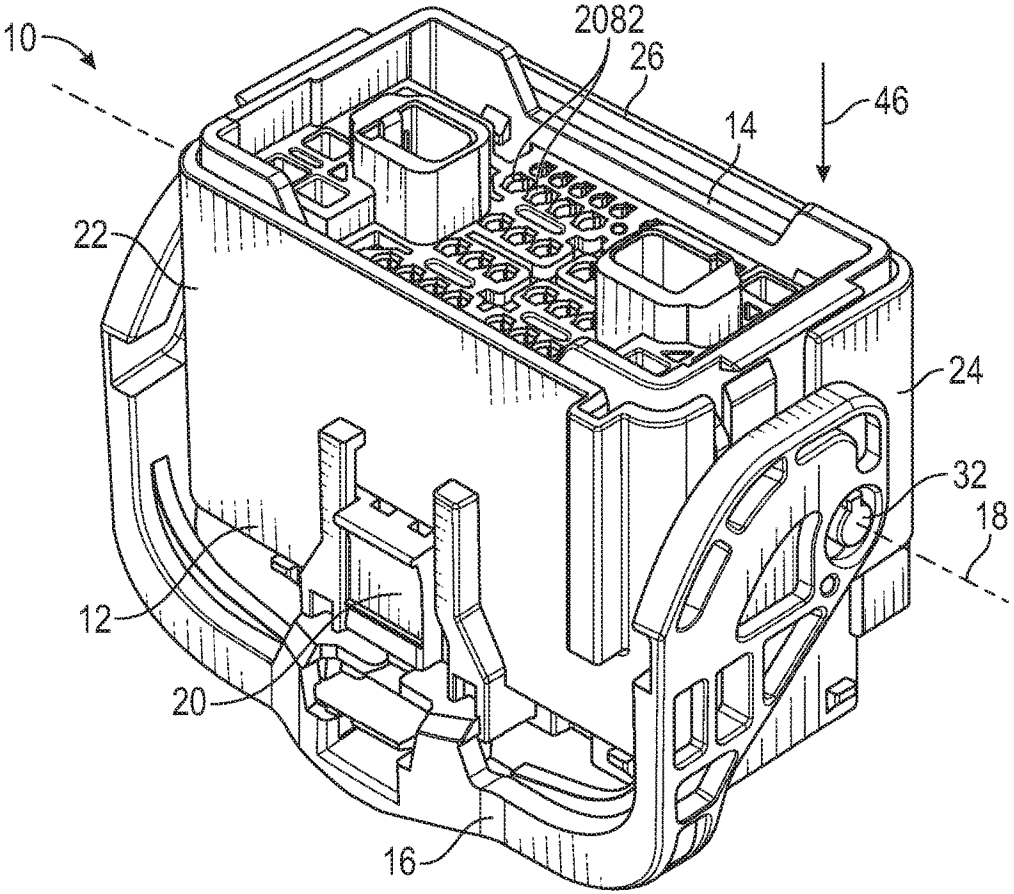
FIG. 1 is a perspective view of an assembled electrical connector.

Referring now to the drawings, there is illustrated in FIG. 1 an electrical connector, indicated generally at 10. The electrical connector 10 includes a first housing 12 and a second housing 14 that is configured to mate with the first housing 12. The second housing 14 is shown in a seated position relative to the first housing 12 in FIG. 1. The electrical connector 10 includes a lever 16 that is mounted on the first housing 12 for relative rotation about a lever axis 18. The lever 16 may be used by an operator to pull the second housing 14 into engagement with the first housing 12. The lever 16 is shown in a final position in FIG. 1. The electrical connector 10 also includes a connector position assurance 20 that is mounted on the first housing 12 for relative movement. The connector position assurance 20 is shown in an assurance position, wherein it engages the lever 16 to prevent the lever 16 from being moved away from the final position.

Figure 2:
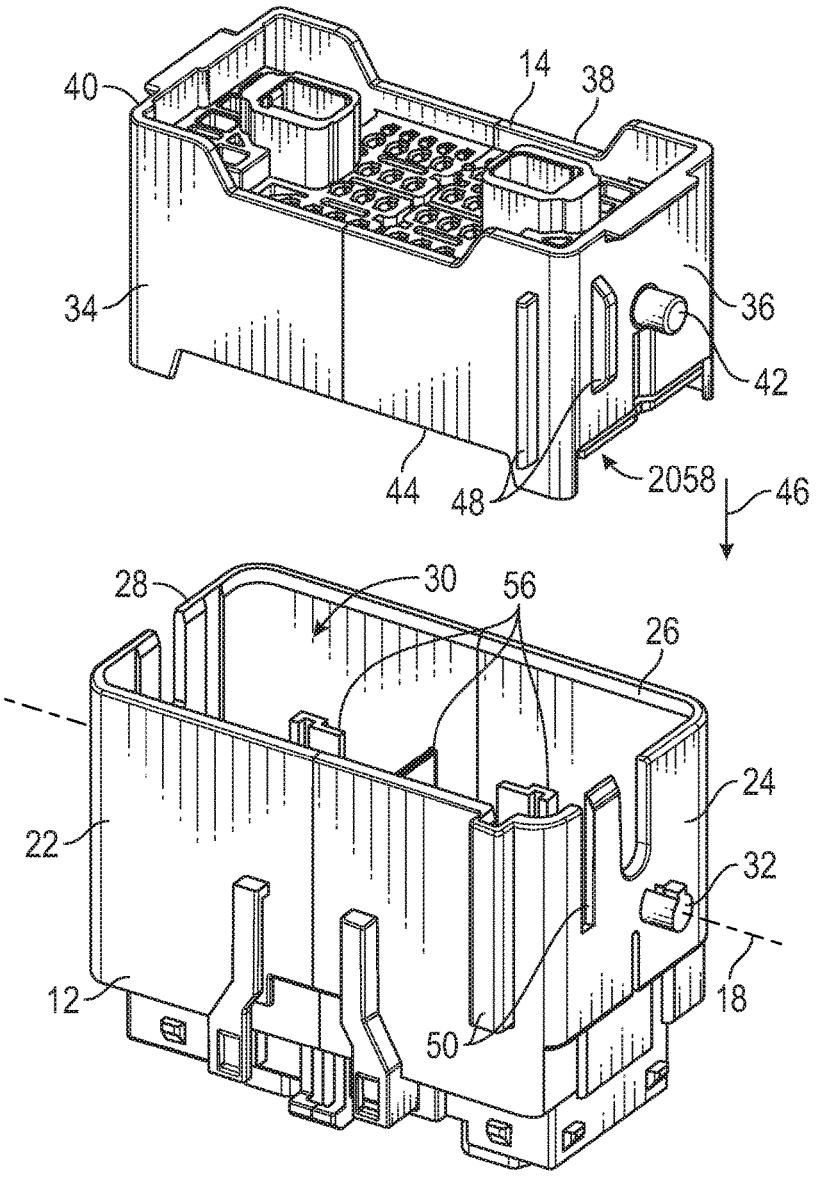
FIG. 2 is a perspective view of a first housing and a separated second housing of the electrical connector of FIG. 1.

Referring to FIG. 2, a perspective view of the first housing 12 and the second housing 14 separated from each other is shown. The illustrated first housing 12 is molded from plastic, but may be made of any desired material and by any desired process. The first housing 12 includes side walls 22, 24, 26, and 28 that define an interior space, indicated generally at 30. The illustrated first housing 12 has four side walls 22, 24, 26, and 28 that define a generally rectangular-shaped interior space 30, but may have any desired number of side walls and any desired shape interior space 30. The first housing 12 includes two axle posts 32 (one is visible in FIG. 2). The illustrated axle posts 32 extend outwardly from opposed side walls 24 and 28, but may be in any desired location on the first housing 12. The axle posts 32 extend along and define the lever axis 18. As shown in FIG. 1, the lever 16 is mounted on the axle posts 32.

The illustrated second housing 14 is molded from plastic, but may be made of any desired material and by any desired process. The second housing 14 has side walls 34, 36, 38, and 40 that define a generally rectangular outer shape. However, the second housing 14 may have any desired outer shape. The second housing 14 is configured to fit into the interior space 30 of the first housing 12, as will be described below. The second housing 14 includes two travel pegs 42 (one is visible in FIG. 2) that extend from opposed sides of the second housing 14. The travel pegs 42 are engaged by the lever 16 to pull the second housing 14 into engagement with the first housing 12.

In order to mate the first housing 12 and the second housing 14, the second housing 14 is positioned with a contact face 44 facing the interior space 30 of the first housing 12. The second housing 14 is moved in an insertion direction 46 relative to the first housing 12 so that the second housing 14 enters the interior space 30. As previously described, in the illustrated embodiment, the lever 16 may be used by the operator to pull the second housing 14 into engagement with the first housing 12. The second housing 14 includes guide elements 48 and the first housing 12 includes cooperating guide elements 50. The guide elements 48 and the cooperating guide elements 50 serve as a poka-yoke to prevent the operator from incorrectly positioning the second housing 14 relative to the first housing 12 during assembly. Additionally, the guide elements 48 and the cooperating guide elements 50 serve to maintain a proper alignment between the second housing 14 and the first housing 12 during assembly.

Figure 3:
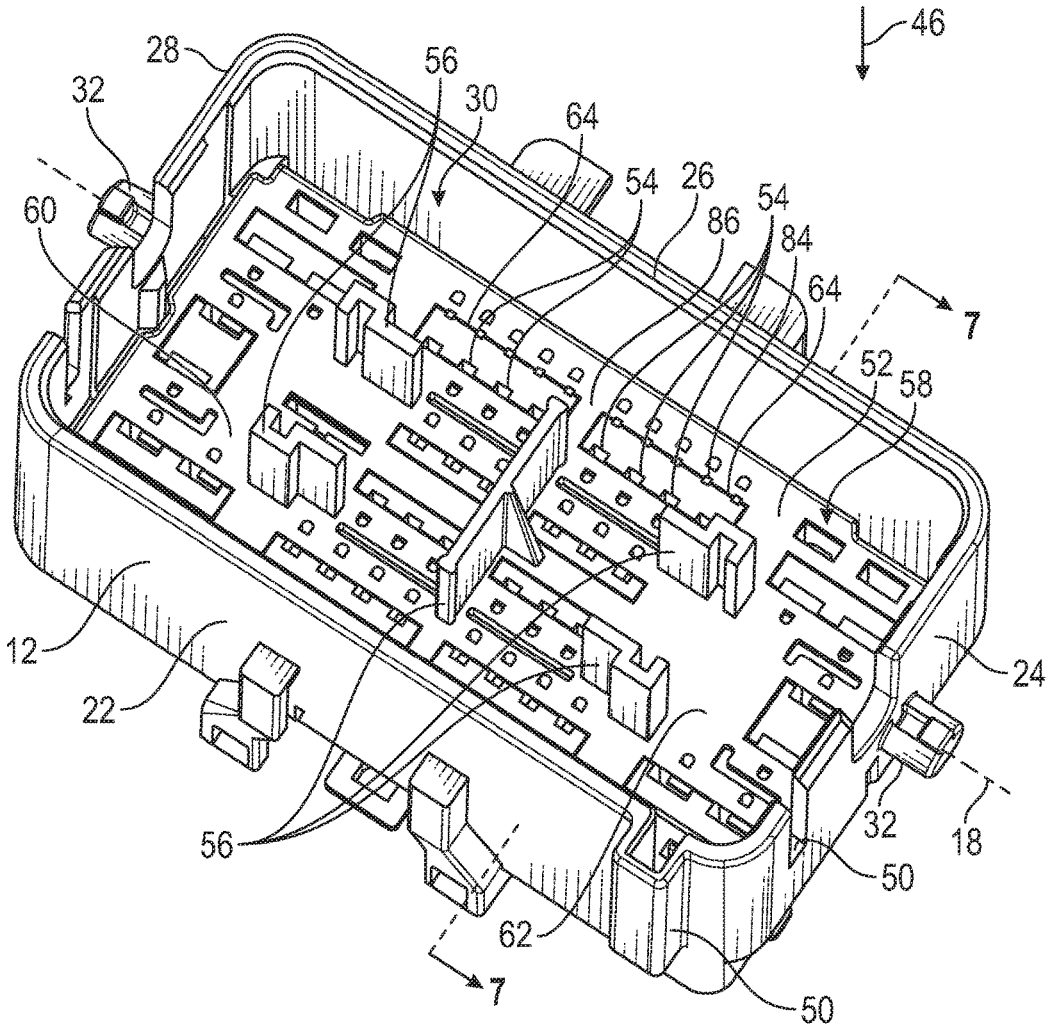
FIG. 3 is a perspective view looking into an interior space of the first housing.

Referring to FIG. 3, a perspective view of the first housing 12 is illustrated, looking down into the interior space 30. The first housing 12 includes a contact face 52 located in the interior space 30. The contact face 52 of the first housing 12 engages the contact face 44 of the second housing 14 when the first housing 12 and the second housing 14 are mated. The first housing 12 includes a plurality of first terminal openings 54 located on the contact face 52. The first housing 12 includes a plurality of towers 56 that extend from the contact face 52, substantially parallel to the insertion direction 46, into the interior space 30. The illustrated first housing 12 includes five towers 56, but may include any desired number of towers 56. The first housing 12 also includes a first terminal position assurance, indicated generally at 58.

Figure 4:
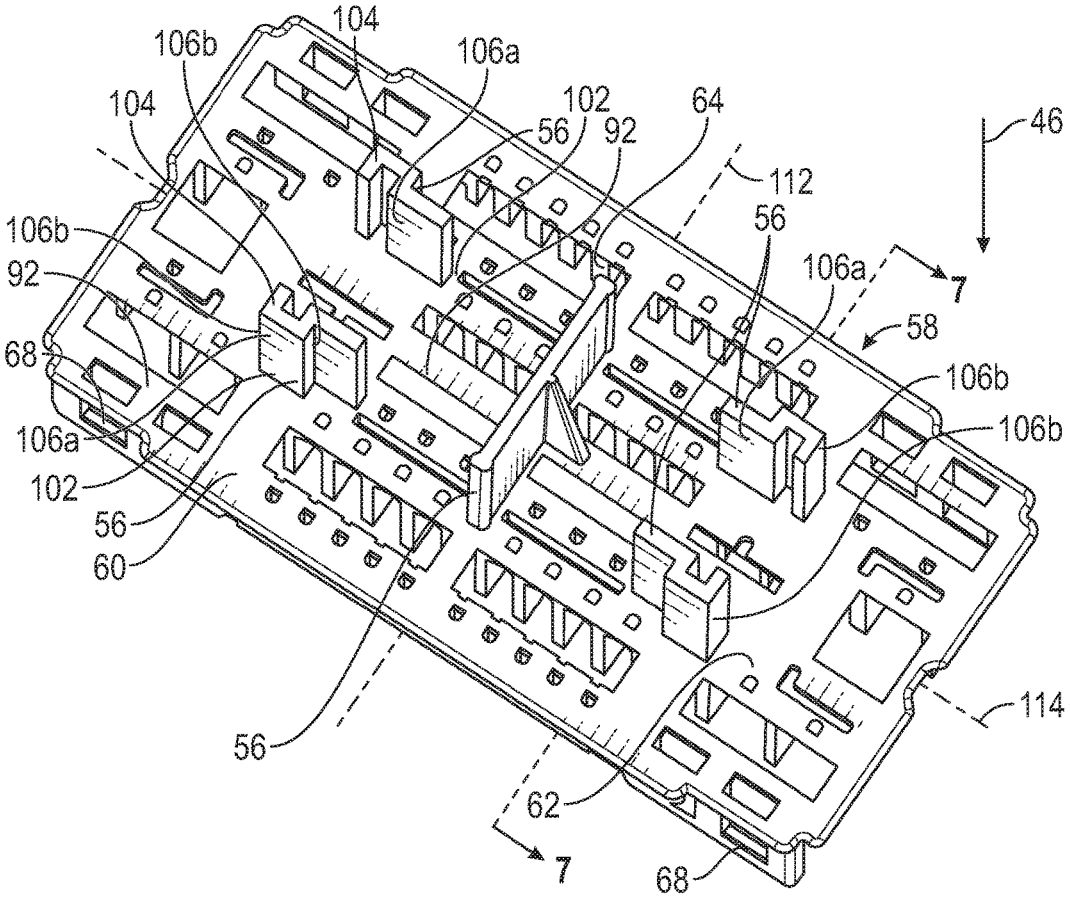
FIG. 4 is a perspective view of a first terminal position assurance from the first housing.
Figure 5:
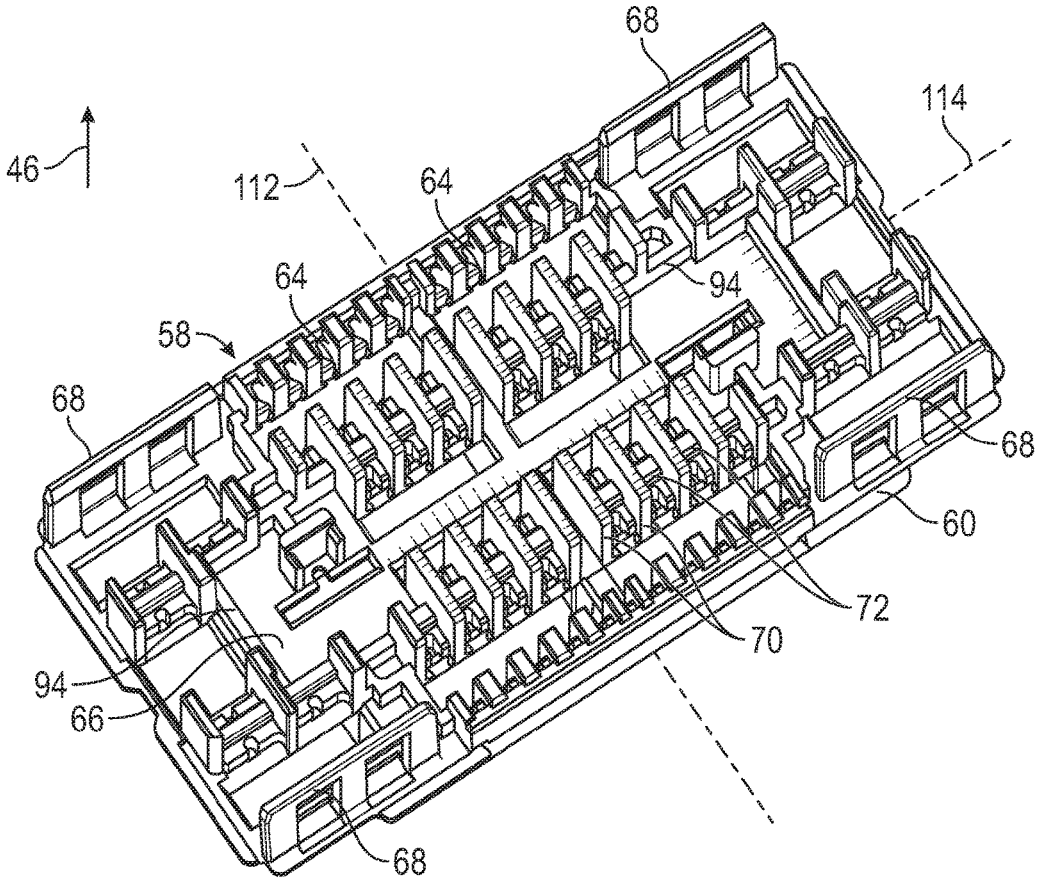
FIG. 5 is a perspective view from below of the first terminal position assurance.

Referring to FIG. 4, a perspective view of the first terminal position assurance 58 is shown. A perspective view, from below, of the first terminal position assurance 58 is shown in FIG. 5. The illustrated first terminal position assurance 58 is molded from plastic, but may be made of any desired material using any desired process. The illustrated first terminal position assurance 58 is a single piece, but may be made of more than one piece, if desired. The first terminal position assurance 58 includes a first terminal position assurance body 60. The illustrated first terminal position assurance body 60 is substantially planar, but may have any desired shape. The first terminal position assurance 58 includes a front face 62 and an opposed back face 66.

The towers 56 extend from the front face 62 of the first terminal position assurance body 60. Each tower 56 includes a respective tower base 102 adjacent to the terminal position assurance body 60, and a respective tower outer end 104. The towers 56 are tapered so that the outer end 104 of each tower 56 has cross-section, taken perpendicular to the insertion direction 46, which is smaller than the cross-section of the respective tower base 102. The towers 56 include tower walls 106 that extend from the tower base 102 to the tower outer end 104. The illustrated towers 56 include forward walls, identified by the reference number 106*a* and substantially perpendicular cross walls, identified by the reference number 106*b*. The tower walls 106*a* and 106*b* extend substantially in the insertion direction 46, but at an angle to the insertion direction 46 in order to allow for the taper of the towers 56. The forward walls 106*a* face generally along a fore-aft axis 112 that is substantially perpendicular to the insertion direction 46, and the cross walls 106*b* face generally along a cross axis 114 that is substantially perpendicular to the insertion direction 46 and substantially perpendicular to the fore-aft axis 112. The tower walls 106 assist in the aligning of the first terminal position assurance 58 during mating of the electrical connector 10, as will be described below. In the illustrated embodiment, some of the towers 56 have a question mark-shaped cross-section and include both forward falls 106*a* and cross walls 106*b*. However, the towers 56 may have any desired shapes.

A plurality of first cut-outs 64 is defined in the first terminal position assurance body 60 and extends completely through the first terminal position assurance body 60. As seen in FIG. 3 and as will be described in greater detail below, when the first terminal position assurance 58 is connected to the first housing 12, the first terminal openings 54 are located in the first cut-outs 64.

Referring back to FIGS. 4 and 5, the first terminal position assurance 58 includes first terminal position assurance locks 68 that extend from the back face 66. The first terminal position assurance locks 68 are resilient arms that engage the first housing 12 to retain the first terminal position assurance 58 in position relative to the first housing 12. The first terminal position assurance 58 includes four first terminal position assurance locks 68, but may include any desired number of locks, and may include any desired retaining structure. The first terminal position assurance 58 includes a plurality of first terminal separations 70 that extend from the back face 66. The first terminal position assurance 58 also includes a plurality of first lock retainers 72 that also extend from the back face 66. The purpose of the first terminal separations 70 and the first lock retainers 72 will be described below.

Figure 6:
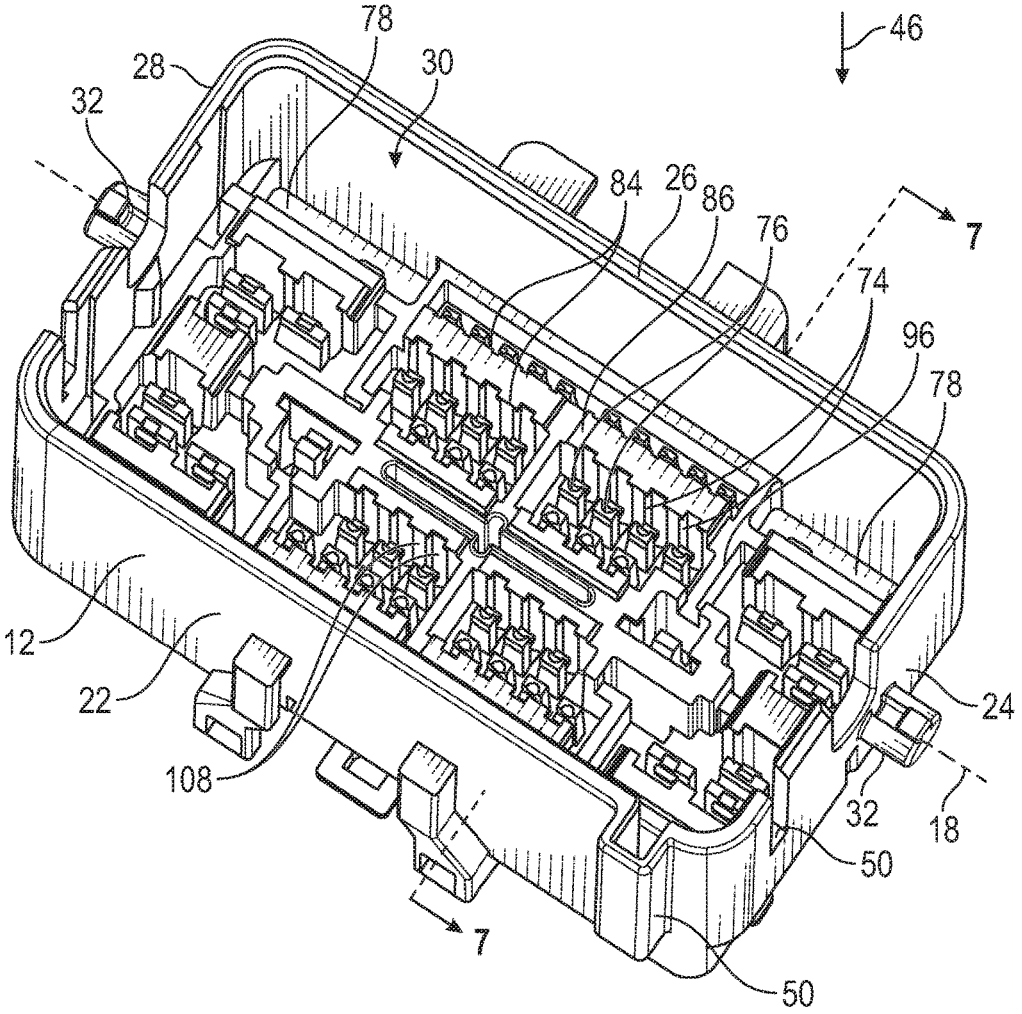
FIG. 6 is a view similar to FIG. 3, showing the first housing with the first terminal position assurance removed therefrom.

Referring to FIG. 6, a perspective view of the first housing 12 similar to FIG. 3 is illustrated, with the first terminal position assurance 58 removed so that the inner structure of the first housing 12 is visible. The first housing 12 includes a plurality of first terminal slots 74, which are configured to accommodate an electrical terminal as will be described below. The illustrated first housing 12 includes sixty two first terminal slots 74, but may include any desired number and size first terminal slots 74. The first housing 12 includes a plurality of first terminal locks 76. The illustrated terminal locks 76 are resilient, plastic arms, but may be any desired lock mechanism. In the illustrated embodiment, each first terminal slot 74 includes a first terminal lock 76, but the first housing 12 may include any desired number and arrangement of first terminal locks 76. The first terminal slots 74 and the terminal locks 76 will be described in greater detail below. The first housing 12 also includes a plurality of first terminal position assurance lock openings 78 that accommodate the first terminal position assurance locks 68. The illustrated first housing 12 includes four first terminal position assurance lock openings 78 (two are visible in FIG. 6), but may include any desired number of first terminal position assurance lock openings 78.

Figure 7:
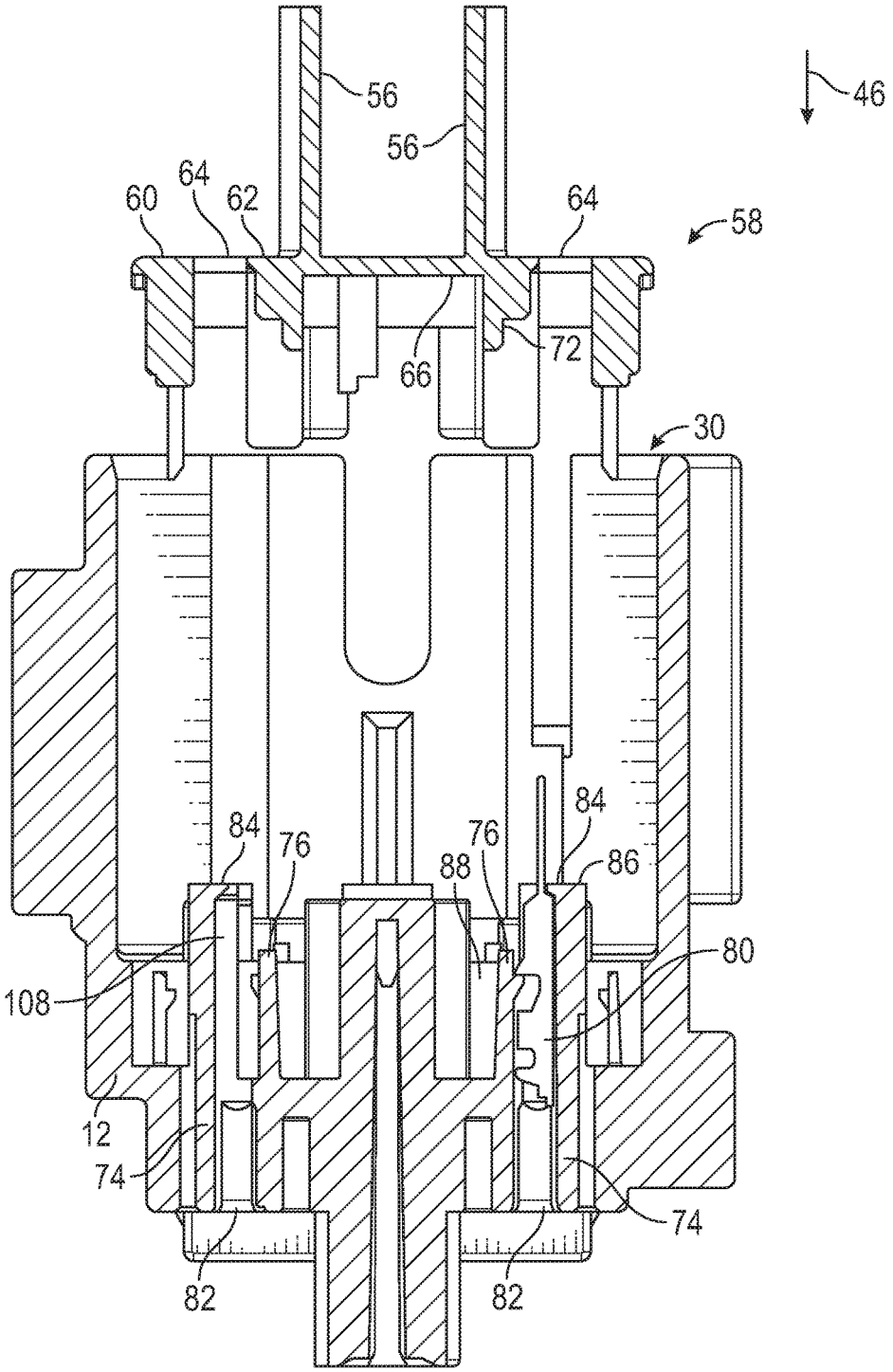
FIG. 7 is a cross-sectional view of the first terminal position assurance and the first housing prior to assembly, taken along the lines 7-7 of FIGS. 4 and 6.

Referring to FIG. 7, a cross-sectional view of the first housing 12 and the first terminal position assurance 58, prior to assembly, are illustrated, taken along the lines 7-7 of FIGS. 4 and 6. A first electrical terminal 80 is shown in one of the first terminal slots 74. Each first terminal slot 74 extends from the interior space 30 to a respective insertion opening 82. Each first terminal slot 74 includes an end stop 84 that extends between a portion of the first terminal slot 74 and the interior space 30. The end stops 84 include a first front stop face 86 that faces the interior space 30. The end stops 84 are a part of the body of the first housing 12. In order to install the first electrical terminal 80 in the first housing 12, the first electrical terminal 80 is inserted through the insertion opening 82 and toward the interior space 30. The first electrical terminal 80 engages and deflects the first terminal lock 76 into a respective first lock space 88. When the first electrical terminal 80 has moved far enough toward the interior space 30, the first terminal lock 76 rebounds to the position shown in FIG. 7. At this point, the first electrical terminal 80 is trapped between the terminal lock 76 and the end stop 84. As a result, the first electrical terminal 80 will remain in the position shown during further handling of the first housing 12.

It should be appreciated that the first electrical terminal 80 will normally be connected to a wire or other conductor, which is not shown in FIG. 7 so that the features of the first housing 12 are clearly visible. As previously described, the illustrated first housing 12 is configured to accommodate sixty two electrical terminals, and the operator will insert all desired electrical connectors in a similar manner.

Figure 8:
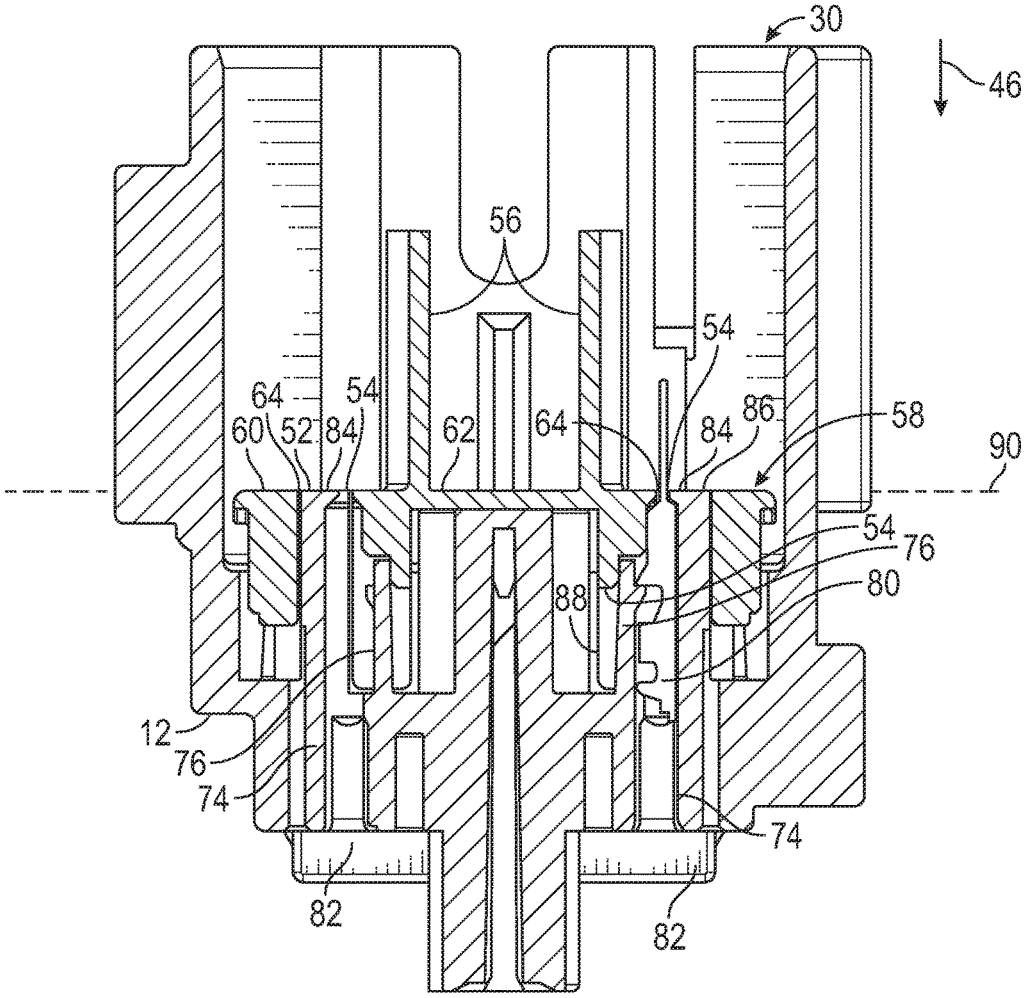
FIG. 8 is a view similar to FIG. 7, shown after assembly of the first terminal position assurance and the first housing.

Referring to FIG. 8, a cross-sectional view similar to FIG. 7 is shown, with the first terminal position assurance 58 shown in an installed position on the first housing 12. This is the condition of the first housing 12 as shown in FIG. 3. The first lock retainers 72 on the first terminal position assurance 58 extend into respective first terminal slots 74 and are located in respective first lock spaces 88. It should be appreciated that if the first electrical terminal 80 is not properly positioned in the first terminal slot 74 between the first terminal lock 76 and the end stop 84 (for example, if the first electrical terminal 80 is only partially inserted, then the terminal lock 76 would remain at least partially in the first lock space 88. This would prevent the full insertion of the first terminal position assurance 58 and provide an indication that the first electrical terminal 80 is not in the proper position. With the first terminal position assurance 58 in the installed position and the first lock retainer 72 located in first lock space 88, the first terminal lock 76 is prevented from deflecting and the first electrical terminal 80 is retained in the first terminal slot 74. The first terminal separations 70 are located adjacent to the first electrical terminal 80 and serve to provide a physical barrier between adjacent electrical terminals (not shown).

A portion of the first terminal position assurance body 60 is located between a portion of the first terminal slot 74 and the interior space 30. Each first terminal opening 54 is located between the first terminal slot 74 and the interior space 30 and is defined between the end stop 84 on the first housing 12 and a portion of the first terminal position assurance body 60.

When the first terminal position assurance 58 is in the installed position, the end stop 84 on the first housing 12 is located in one of the cut-outs 64. Additionally, the front face 62 of the first terminal position assurance 58 is substantially co-planar with the stop face 86. In the illustrated embodiment, the first terminal position assurance body 60 and the end stops 84 share a space between the first terminal slots 74 and the interior space 30, and are both located in a stop plane 90 that is substantially perpendicular to the insertion direction 46. As a result, the first electrical terminal 80 is retained in the first terminal slot 74 prior to the first terminal position assurance 58 being placed in the installed position, by being trapped between the end stops 84 and the first terminal lock 76. The first terminal position assurance 58 may be placed into the installed position without increasing the distance between the first terminal slot 74 and the interior space 30. The advantage of this arrangement will be described below.

It should be appreciated that in the illustrated embodiment, the cut-outs 64 in the first terminal position assurance 58 are configured to allow for the first terminal position assurance body 60 to be coplanar with the end stops 84. However, as best seen in FIG. 4, the cut-outs 64 decrease the size of the first terminal position assurance body 60 and provide thin areas 92. These thin areas 92 are structurally weaker than the rest of the first terminal position assurance body 60, and in order to reinforce the thin areas 92 the first terminal position assurance 58 includes extension walls 94, shown in FIG. 5. The extension walls 94 extend from the back face 66 of the first terminal position assurance body 60, substantially perpendicular to the back face 66. As shown in FIG. 6, the first housing 12 includes extension openings 96 that accommodate the extension walls 94 when the first terminal position assurance 58 is in the installed position. As a result, the first terminal position assurance body 60 is reinforced without increasing the distance between the front face 62 and the first electrical terminal 80. The advantage of this arrangement will be described below.

Referring back to FIG. 8, in the illustrated embodiment the first electrical terminal 80 extends from the first terminal slot 74 into the interior space 30, and extends a distance from the front face 62 of the first terminal position assurance 58. The interior space 30 is defined by the side walls 22, 24, 26, and 28 (shown in FIG. 6), which extend a greater distance from the front face 62. Additionally, the towers 56 extend into the interior space 30, and extend a greater distance from the front face 62 than the first electrical terminal 80. As a result, the towers 56 provide touch protection for the first electrical terminal 80, and prevent large objects that enter the interior space from contacting the first electrical terminal 80.

Figure 9:
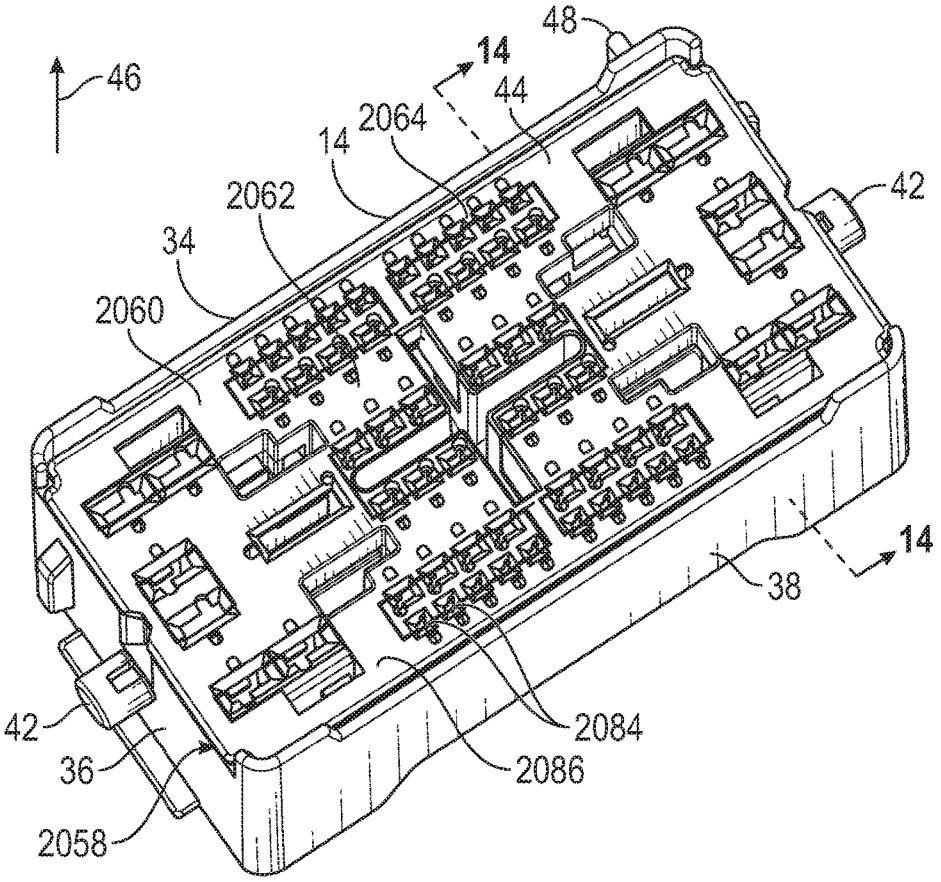
FIG. 9 is a perspective view, from below, of the second housing of FIG. 2.
Figure 10:
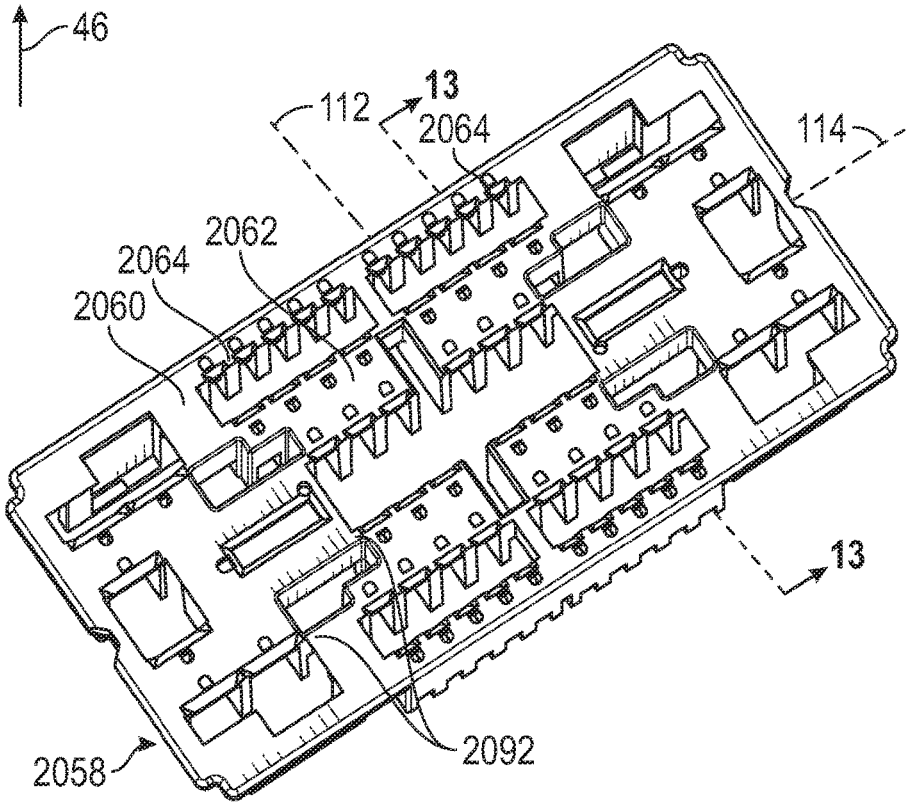
FIG. 10 is a perspective view of a second terminal position assurance from the second housing.
Figure 11:
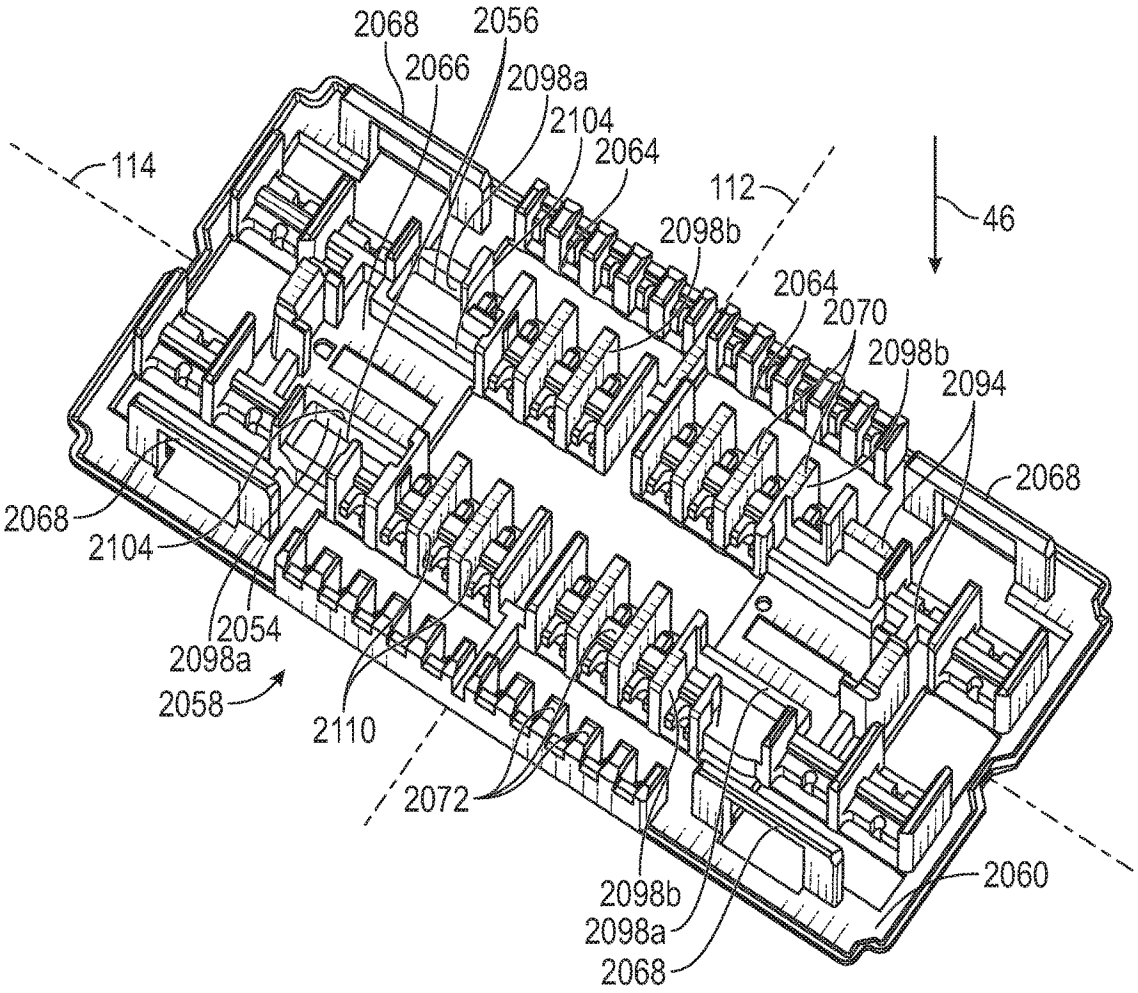
FIG. 11 is a perspective view from below of the second terminal position assurance.
Figure 12:
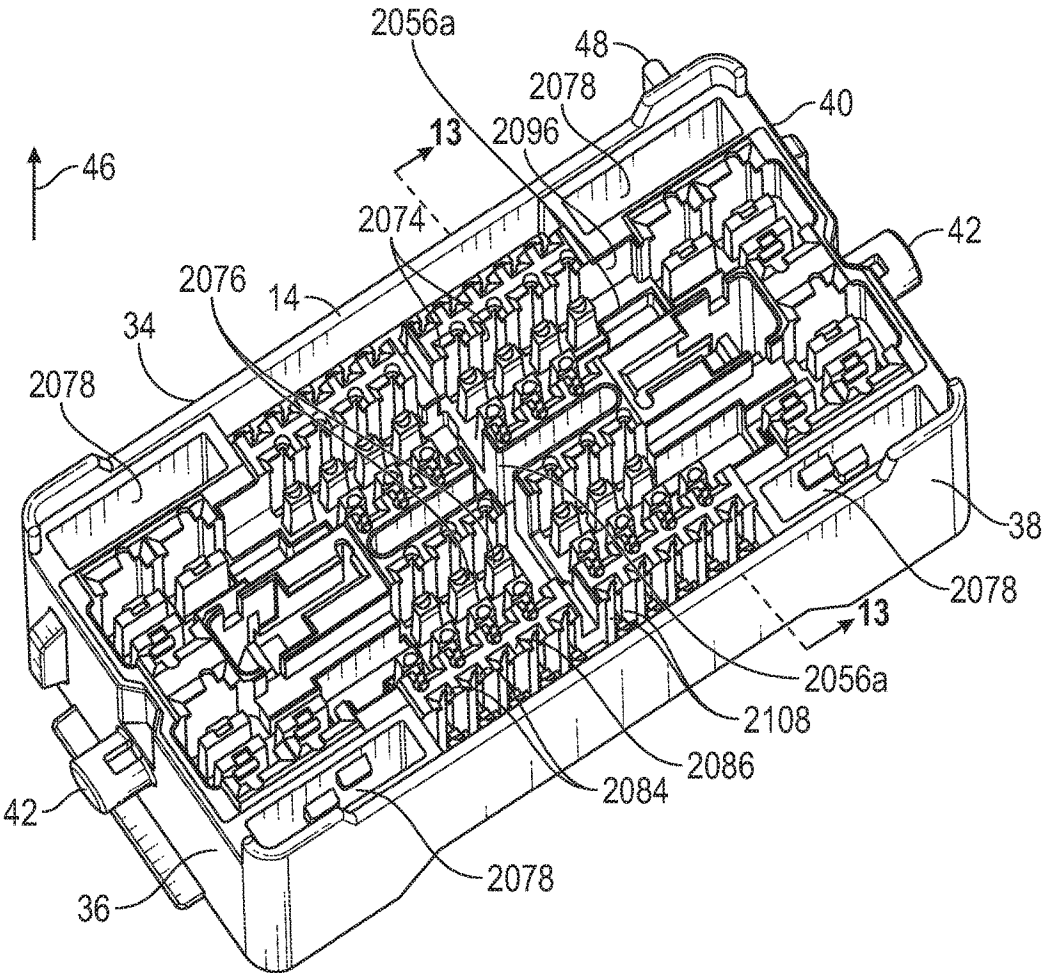
FIG. 12 is a view similar to FIG. 9, showing the second housing with the second terminal position assurance removed therefrom.
Figure 13:
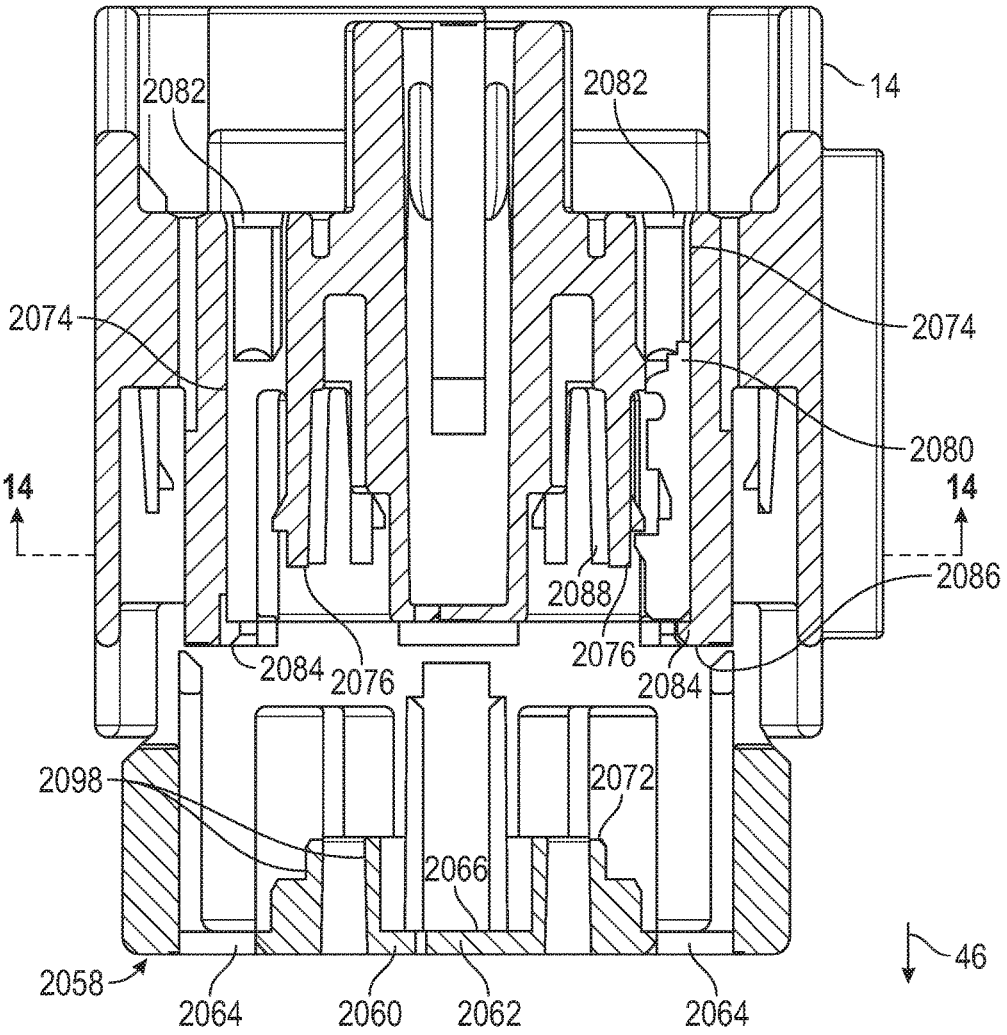
FIG. 13 is a cross-sectional view of the second terminal position assurance and the second housing prior to assembly, taken along the lines 13-13 of FIGS. 10 and 12.
Figure 14:
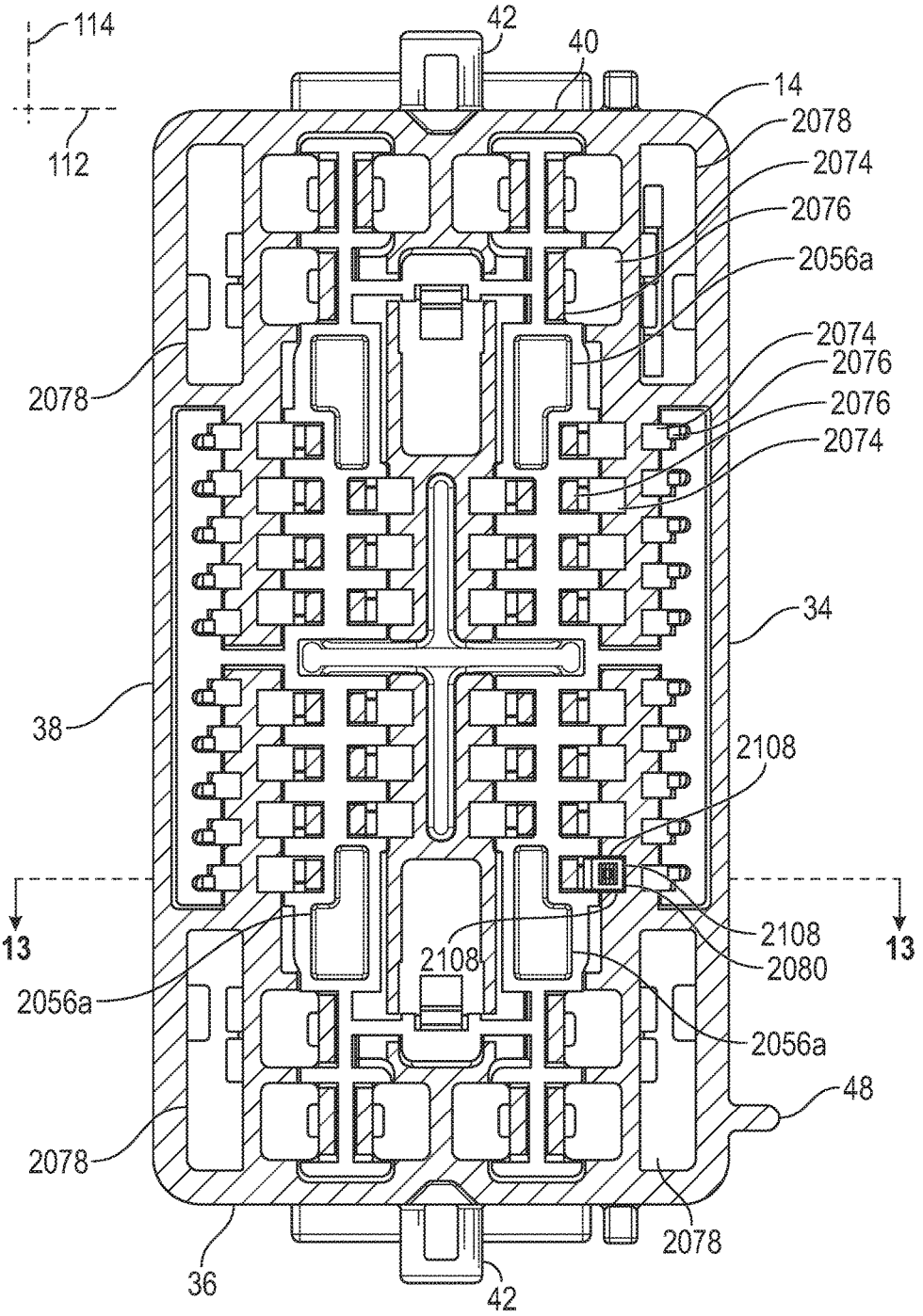
FIG. 14 is a cross-sectional view of the second housing with a second terminal, taken along the line 14-14 of FIG. 13.

Referring to FIG. 9, a perspective view, from below, of the second housing 14 is shown. The view shown in FIG. 9 is looking toward the contact face 44 of the second housing 14. The second housing 14 includes many features that are similar to the previously-described first housing 12. Similar features will be identified by the same reference number increased by 2000, and will not be described in detail. The second housing 14 includes a second terminal position assurance, indicated generally at 2058. FIG. 10 is a perspective view of the second terminal position assurance 2058, and FIG. 11 is a perspective view of the second terminal position assurance 2058 from below. FIG. 12 is a view similar to FIG. 9, showing the second housing 14 with the second terminal position assurance 2058 removed therefrom. FIG. 13 is cross-sectional view of the second housing 14 and the second terminal position assurance 2058 prior to assembly, and FIG. 14 is a cross-sectional view of the assembled second housing 14 taken along the line 14-14 of FIG. 2. The features of the second housing 14 will be described in reference to these figures.

The second housing 14 includes a plurality of terminal openings 2054 located on the contact face 44. The terminal openings 2054 are arranged to align with the terminal openings 54 on the first housing 12 when the first housing 12 and the second housing 14 are mated so that the first electrical terminal 80 will extend through one of the terminal openings 2054. The illustrated second housing 14 includes sixty two terminal openings 2054, but may include any desired number and arrangement of terminal openings 2054. The second housing 14 includes a plurality of tower openings 2056 on the contact face 44. The tower openings 2056 are positioned and shaped to accommodate the towers 56 on the first housing 12, and will be described in greater detail below.

The illustrated second terminal position assurance 2058 is molded from plastic, but may be made of any desired material using any desired process. The illustrated second terminal position assurance 2058 is a single piece, but may be made of more than one piece, if desired. The second terminal position assurance 2058 includes a second terminal position assurance body 2060. The illustrated second terminal position assurance 2058 body 2060 is substantially planar, but may have any desired shape. The second terminal position assurance 2058 includes a front face 2062 and an opposed back face 2066. The tower openings 2056 extend through the second terminal position assurance body 2060. A plurality of second cut-outs 2064 defined in the second terminal position assurance body 2060 extend completely through the second terminal position assurance body 2060. The second terminal openings 2054 are located in the second cut-outs 2064.

The second terminal position assurance 2058 includes second terminal position assurance locks 2068 that extend from the back face 2066. The second terminal position assurance locks 2068 are resilient arms that engage the second housing 14 to retain the second terminal position assurance 2058 in position relative to the second housing 14. The second terminal position assurance 2058 includes four second terminal position assurance locks 2068, but may include any desired number of locks, and may include any desired retaining structure. The second terminal position assurance 2058 includes a plurality of second terminal separations 2070 that extend from the back face 2066. The second terminal position assurance 2058 also includes a plurality of second lock retainers 2072 that also extend from the back face 2066.

The second housing 14 includes a plurality of second terminal slots 2074, which are configured to accommodate electrical terminals. The illustrated second housing 14 includes sixty two second terminal slots 2074, but may include any desired number and size second terminal slots 2074. The second housing 14 includes a plurality of second terminal locks 2076. The illustrated second terminal locks 2076 are resilient, plastic arms, but may be any desired lock mechanism. In the illustrated embodiment, each second terminal slot 2074 includes a second terminal lock 2076, but the second housing 14 may include any desired number and arrangement of second terminal locks 2076. The second housing 14 also includes a plurality of second terminal position assurance lock openings 2078 that accommodate the second terminal position assurance locks 2068. The illustrated second housing 14 includes four second terminal position assurance lock openings 2078, but may include any desired number of second terminal position assurance lock openings 2078.

Referring to FIG. 13, a second electrical terminal 2080 is shown in one of the second terminal slots 2074. The illustrated second electrical terminal 2080 is a female electrical terminal and is configured to mate with the first electrical terminal 80. Each second terminal slot 2074 extends from the contact face 44 to a respective insertion opening 2082. Each second terminal slot 2074 includes an end stop 2084 that extends over a portion of the second terminal slot 2074. The end stops 2084 include a second front stop face 2086 that is part of the contact face 44. In order to install the second electrical terminal 2080 in the second housing 14, the second electrical terminal 2080 is inserted through the insertion opening 2082 and toward the contact face 44. The second electrical terminal 2080 engages and deflects the second terminal lock 2076 into a second lock space 2088. When the second electrical terminal 2080 has moved far enough toward the contact face 44 the second terminal lock 2076 rebounds to the position shown in FIG. 13. At this point, the second electrical terminal 2080 is trapped between the second terminal lock 2076 and the end stop 2084.

It should be appreciated that the second electrical terminal 2080 will normally be connected to a wire or other conductor, which is not shown in FIG. 13 so that the features of the second housing 14 are clearly visible. As previously described, the illustrated second housing 14 is configured to accommodate sixty two electrical terminals, and the operator will insert all desired electrical connectors in a similar manner.

Referring to FIG. 14, a cross-sectional view taken along the line 14-14 of FIG. 13 is shown, looking at the second housing 14 opposite the insertion direction 46. The second housing 14 is shown with only one second electrical terminal 2080 attached, so that the features of the second housing 14 are visible. However, in normal use the illustrated second housing 14 may accommodate up to sixty two total electrical terminals. The terminal slot 2074 is defined by housing slot walls 2108 that are located around the second electrical terminal 2080. The illustrated housing slot walls 2108 are located on three sides of the second electrical terminal 2080, but may be located on any desired number of sides of the second electrical terminal 2080. The second electrical terminal 2080 is trapped between the housing slot walls 2108 and the second terminal lock 2076. As a result, the second electrical terminal 2080 will remain in the position shown during further handling of the second housing 14. Although a cross-section similar to FIG. 14 is not shown for the first housing 12, it should be appreciated that the first terminal 80 is similarly held in place is between housing slot walls 108 and the first terminal lock 76, which can be seen in FIGS. 6 and 7.

Figure 15:
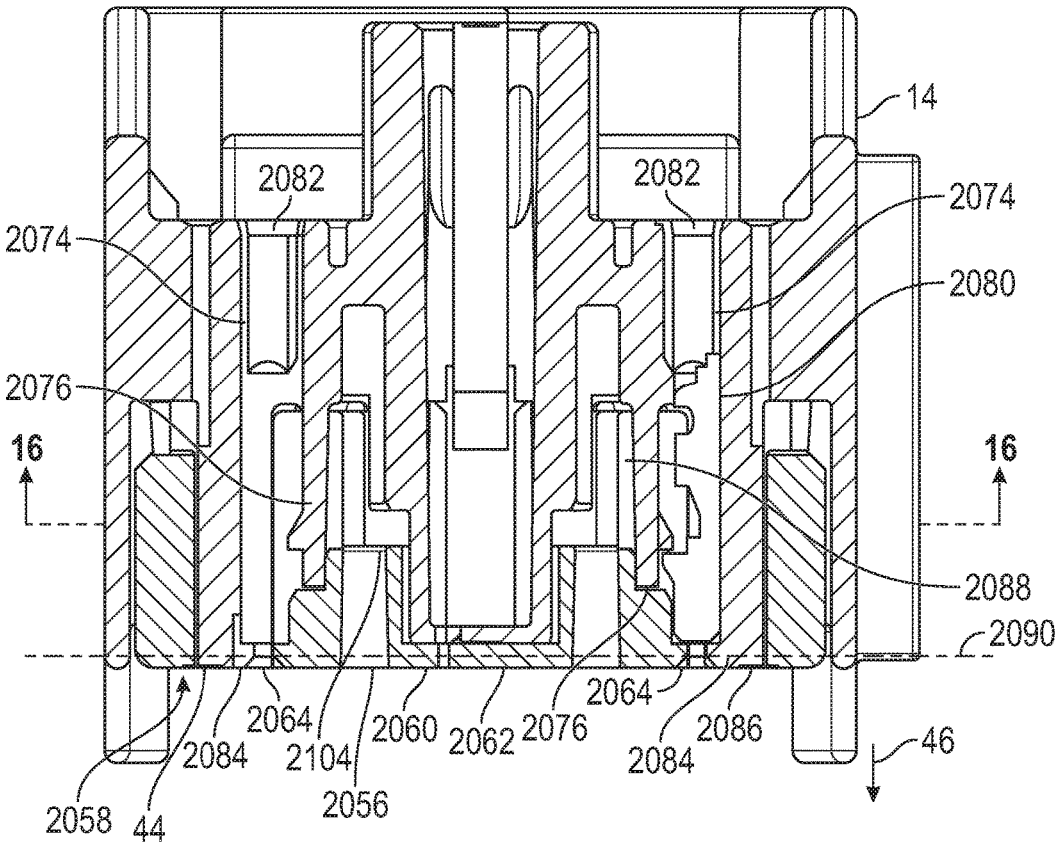
FIG. 15 is a cross-sectional view of the assembled second housing taken along the line 15-15 of FIG. 14.

Referring to FIG. 15, a cross-sectional view similar to FIG. 13 is shown, with the second terminal position assurance 2058 shown in an installed position on the second housing 14. This is the condition of the second housing 14 as shown in FIG. 9. The second lock retainers 2072 on the second terminal position assurance 2058 extend into respective second terminal slots 2074 and are located in respective second lock spaces 2086. It should be appreciated that if the second electrical terminal 2080 is not properly positioned in the second terminal slot 2074 between the second terminal lock 2076 and the end stop 2084, then the second terminal lock 2076 would remain at least partially in the second lock space 2088. This would prevent the full insertion of the second terminal position assurance 2058 and provide an indication that the second electrical terminal 2080 is not in the proper position. With the second terminal position assurance 2058 in the installed position and the second lock retainer 2072 located in second lock space 2088, the second terminal lock 2076 is prevented from deflecting and the second electrical terminal 2080 is retained in the second terminal slot 2074.

Figure 16:
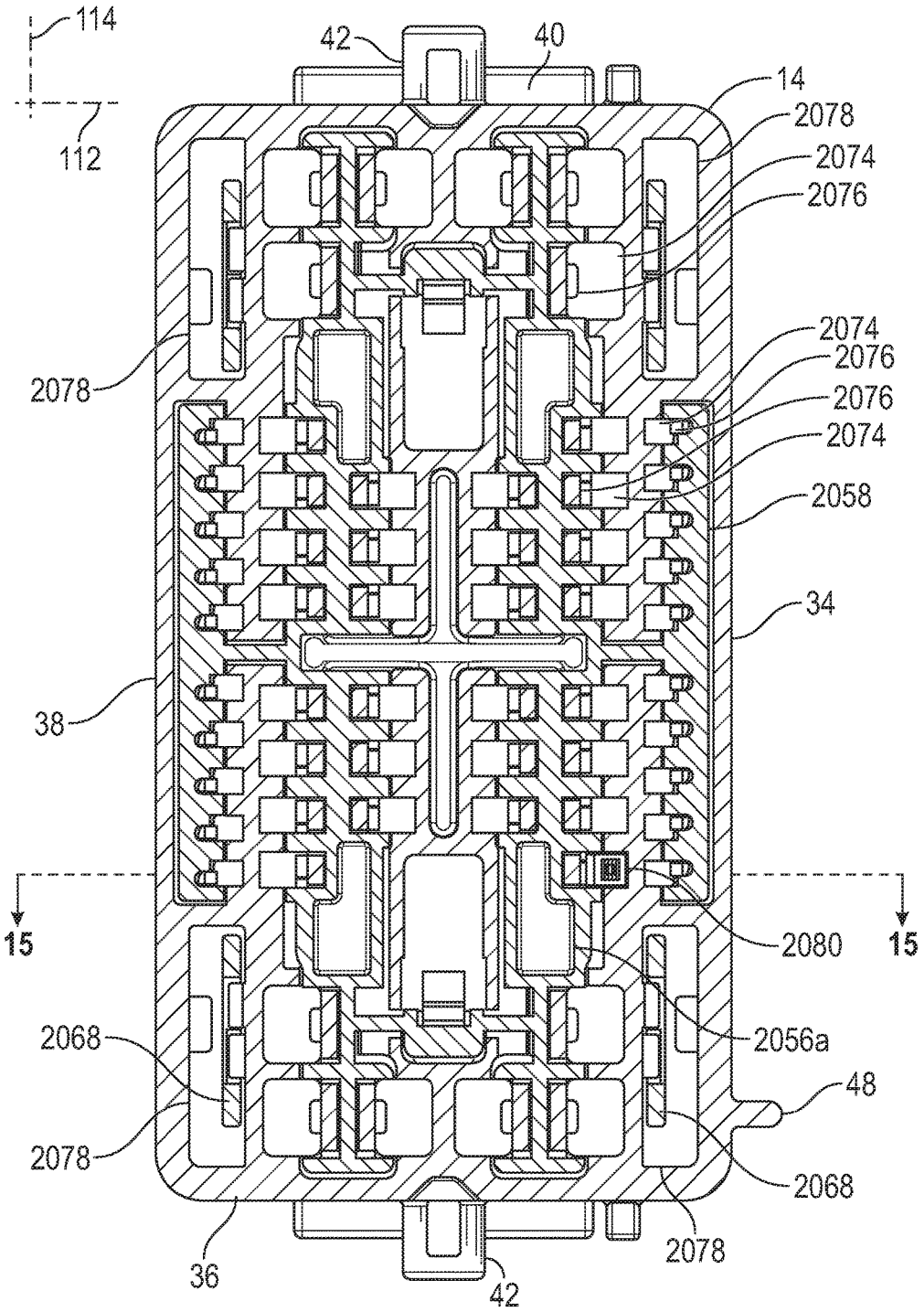
FIG. 16 is a view similar to FIG. 14, showing the second housing with the second terminal position assurance attached.

Referring to FIG. 16, a view similar to FIG. 14 is illustrated, taken along the line 16-16 of FIG. 15, showing a cross-section of the second housing 14 with the second terminal position assurance 2058 in the installed position. The second terminal position assurance 2058 includes assurance slot walls 2110 that are located around the second electrical terminal 2080. The assurance slot walls 2110 are surfaces of the second terminal separations 2070 and are located on two sides of the second terminal 2080. As a result, the second electrical terminal 2080 is in a fixed position relative to the second terminal position assurance 2058. Although a cross-section similar to FIG. 16 is not shown for the first housing 12, it should be appreciated that the first terminal 80 is similarly in a fixed position relative to the first terminal position assurance 58.

A portion of the second terminal position assurance body 2060 extends over a portion of the second terminal slot 2074. Each second terminal opening 2054 is defined between the end stop 2084 on the second housing 14 and a portion of the second terminal position assurance body 2060.

When the second terminal position assurance 2058 is in the installed position, the end stop 2084 on the second housing 14 is located in one of the cut-outs 2064. Additionally, the front face 2062 of the second terminal position assurance 2058 is substantially co-planar with the stop face 2086. In the illustrated embodiment, the second terminal position assurance body 2060 and the end stops 2084 share a space and are both located in a second stop plane 2090 that is substantially perpendicular to the insertion direction 46. As a result, the second electrical terminal 2080 is retained in the second terminal slot 2074 prior to the second terminal position assurance 2058 being placed in the installed position, by being trapped between the end stops 2084 and the second terminal lock 2076. And the second terminal position assurance 2058 may be placed into the installed position without increasing the distance between the second terminal slot 2074 and the contact face 44. The advantage of this arrangement will be described below.

It should be appreciated that in the illustrated embodiment, the cut-outs 2064 in the second terminal position assurance 2058 are configured to allow for the second terminal position assurance body 2060 to be coplanar with the end stops 2084. However, as best seen in FIG. 10, the cut-outs 2064 decrease the size of the second terminal position assurance body 2060 and provide thin areas 2092. These thin areas 2092 are structurally weaker than the rest of the second terminal position assurance body 2060, and in order to reinforce the thin areas 2092 the first terminal position assurance 2058 includes extension walls 2094, shown in FIG. 11. The extension walls 2094 extend from the back face 2066 of the second terminal position assurance body 2060, substantially perpendicular to the back face 2066. As shown in FIG. 12, the second housing 14 includes extension openings 2096 that accommodate the extension walls 2094 when the second terminal position assurance 2058 is in the installed position. As a result, the second terminal position assurance body 2060 is reinforced without increasing the distance between the front face 2062 and the second electrical terminal 2080. The advantage of this arrangement will be described below.

Referring back to FIG. 11, the second terminal position assurance 2058 also includes a plurality of guide walls 2098 that extend from the back face 2066, substantially perpendicular to the back face 2066. The guide walls 2098 are located adjacent to the tower openings 2056 and extend around the perimeter of the tower openings 2056 to a respective guide outer end 2104. Each guide outer end 2104 defines a space that that has the same shape as the respective tower opening 2056. The guide walls 2098 are tapered so that the space at the guide outer end 2104 has a cross-section, taken perpendicular to the insertion direction 46, which is smaller than the cross-section of the respective tower opening 2056. The guide walls 2098 include forward guide walls, identified by the reference number 2098*a*, and substantially perpendicular cross guide walls, identified by the reference number 2098*b*. The guide walls 2098*a* and 2098*b* extend substantially in the insertion direction 46, but at an angle to the insertion direction 46 in order to allow for the taper of the guide walls 2098. The forward guide walls 2098*a* and the cross guide walls 2098*b* face in substantially perpendicular directions, which assists in the aligning of the second terminal position assurance 2058 during mating of the electrical connector 10, as will be described below.

As shown in FIG. 12, the second housing 14 includes a plurality of housing tower openings 2056*a* which are configured to accommodate the guide walls 2098 when the second terminal position assurance 2058 is in the installed position, as well as the towers 56 when the first housing 12 is in the seated position.

Figure 17:
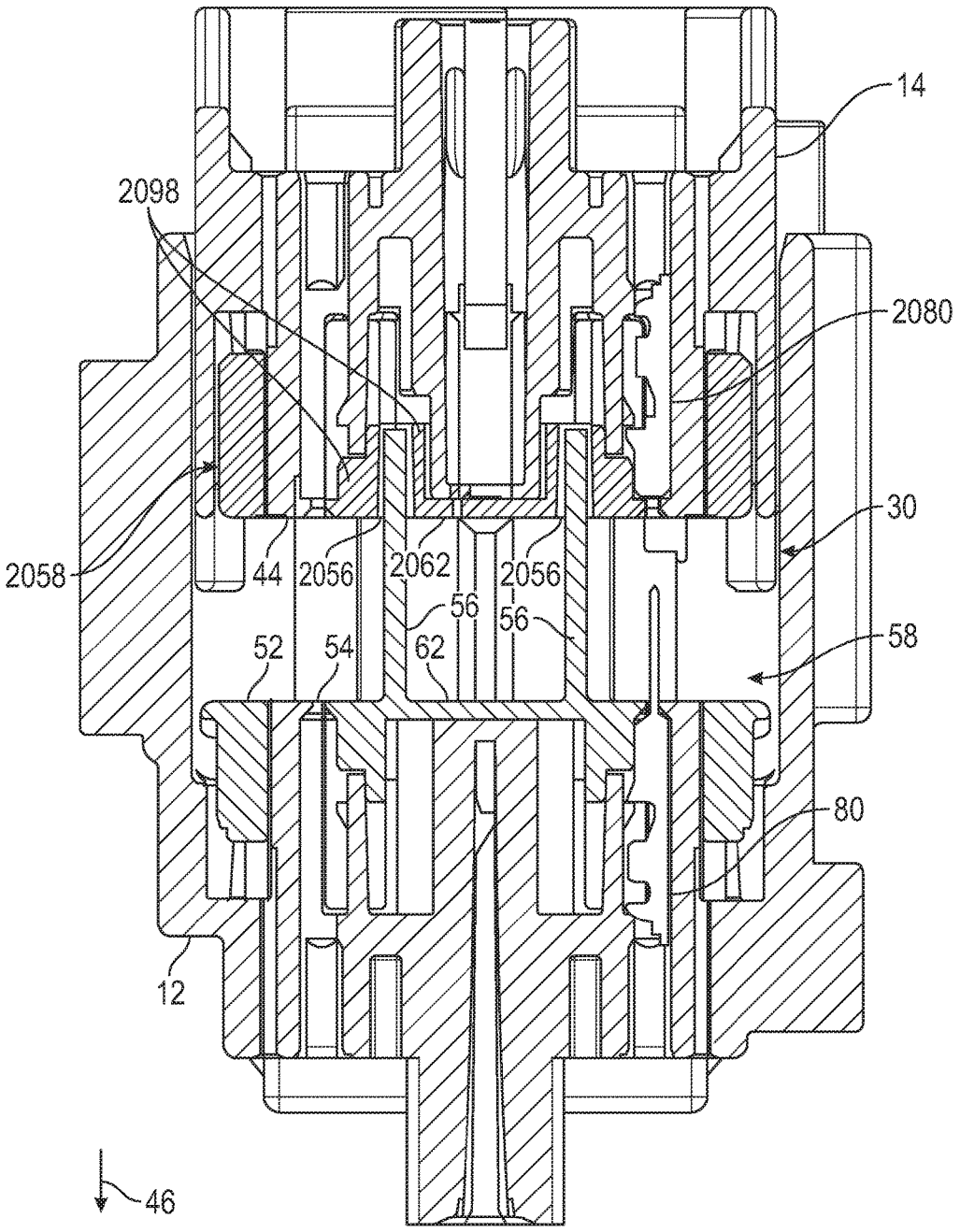
FIG. 17 is a cross-sectional view of the first housing and the second housing in a pre-mate position.

As previously described, in order to mate the first housing 12 and the second housing 14, the second housing 14 is positioned with the contact face 44 facing the interior space 30 of the first housing 12. The second housing 14 is moved in the insertion direction 46 relative to the first housing 12 so that the second housing 14 enters the interior space 30 and the second housing 14 is in a pre-mate position relative to the first housing 12. Referring to FIG. 17, a cross-sectional view similar to FIGS. 8 and 15 is illustrated, showing the first housing 12 and the second housing 14 in the pre-mate position.

In the illustrated embodiment, when the first housing 12 and the second housing 14 are in the pre-mate position, the first electrical terminal 80 has not engaged the second electrical terminal 2080. The towers 56 have entered the tower openings 2056. Initially, the tower outer end 104 of each tower 56 enters the respective tower opening 2056. As previously described, the tower outer end 104 is relatively narrow, while the tower opening 2056 is relatively wide. As a result, the tower 56 is able to enter the respective tower opening 2056 even if the first terminal position assurance 58 and the second terminal position assurance 2058 are slightly out of alignment. The forward walls 106*a* of the towers 56 may engage forward guide walls 2098*a* in order to move the second terminal position assurance 2058 into proper alignment with the first terminal position assurance 58 along the fore-aft axis 112. Similarly, the cross walls 106*b* may engage cross guide walls 2098*b* in order to move the second terminal position assurance 2058 into proper alignment with the first terminal position assurance 58 along the cross axis 114.

As the second housing 14 is moved in the insertion direction 46 relative to the first housing 12, the wider tower base 102 is moved toward the second terminal position assurance 2058, while the narrower guide outer end 2104 is moved toward the first terminal position assurance 58. As a result, the wider part of the tower 56 is moved between the narrower guide outer end 2104 and the amount of misalignment between the first terminal position assurance 58 and the second terminal position assurance 2058 decreases as the first housing 12 and the second housing 14 are brought closer together. As previously described, the first terminal 80 is in a fixed position relative to the first terminal position assurance 58 and the second electrical terminal 2080 is in a fixed position relative to the second terminal position assurance 2058. Therefore, the towers 56 and the guide walls 2098 cooperate to align the first electrical terminal 80 and the second electrical terminal 2080 prior to the first electrical terminal 80 engaging the second electrical terminal 2080. Alternatively, the electrical connector may include longer electrical terminals (not shown) that engage before the first electrical terminal 80 and the second electrical terminal 2080, if desired. For example, the electrical connector 10 may include relatively large electrical terminals that are unlikely to be damaged during normal handling.

As previously described, in the illustrated embodiment, the lever 16 (shown in FIG. 1) may be used by the operator to pull the second housing 14 into engagement with the first housing 12. In normal use, the operator will manually place the second housing 14 in the pre-mate position relative to the first housing 12 as shown in FIG. 17, then use the lever 16 to pull the second housing 14 in the insertion direction 46 to the seated position, shown in FIG. 18. The cooperation of the towers 56 and the guide walls 2098 allows the second housing 14 to be placed in a position that is sufficiently aligned with the first housing 12, and then the second housing 14 is fully aligned with the first housing 12 while being moved from the pre-mate position to the seated position, before the first electrical terminal 80 engages the second electrical terminal 2080.

Figure 18:
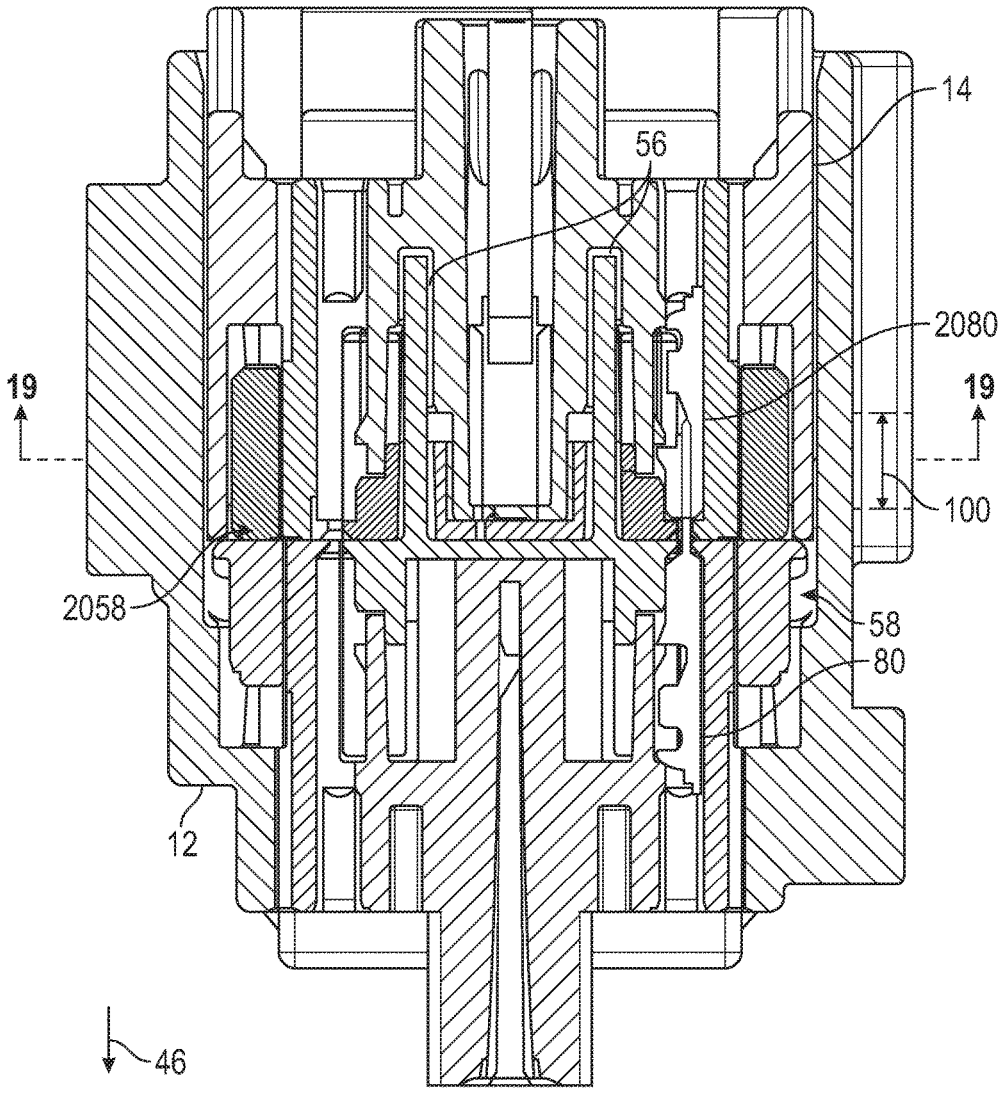
FIG. 18 is a view similar to FIG. 17, showing the first housing and the second housing in a seated position.

FIG. 18 illustrates a cross-sectional view similar to FIG. 17, with the first housing 12 and the second housing 14 shown in the seated position. The contact face 52 of the first housing 12 has engaged the contact face 44 of the second housing 14. Additionally, the front face 62 of the first terminal position assurance 58 has engaged the front face 2062 of the second terminal position assurance 2058. The first electrical terminal 80 has engaged the second electrical terminal 2080 and the engagement has a wipe distance 100. The wipe distance 100 is the length of the first electrical terminal 80 that the second electrical terminal 2080 travels along when the electrical terminal 80 and 2080 are engaged.

As previously described, the first terminal position assurance body 60 shares space with the end stops 84. It should be appreciated that if the first terminal position assurance body 60 were positioned so that the back face 66 was engaged with the first front stop face 86, then the distance between the first electrical terminal 80 and the second electrical terminal 2080 would be increased. This would reduce the size or the wipe distance 100 or require a larger first electrical terminal 80 in order to maintain the same size wipe distance 100. Increasing the size of the first electrical terminal 80 may result in increasing the length of the towers 56 in order to maintain the desired touch protection, and this may result in an overall increase in the size of the first housing 12 and the electrical connector 10. Similarly, the second terminal position assurance body 2060 shares space with the end stops 2084 for a similar reason.

Figure 19:
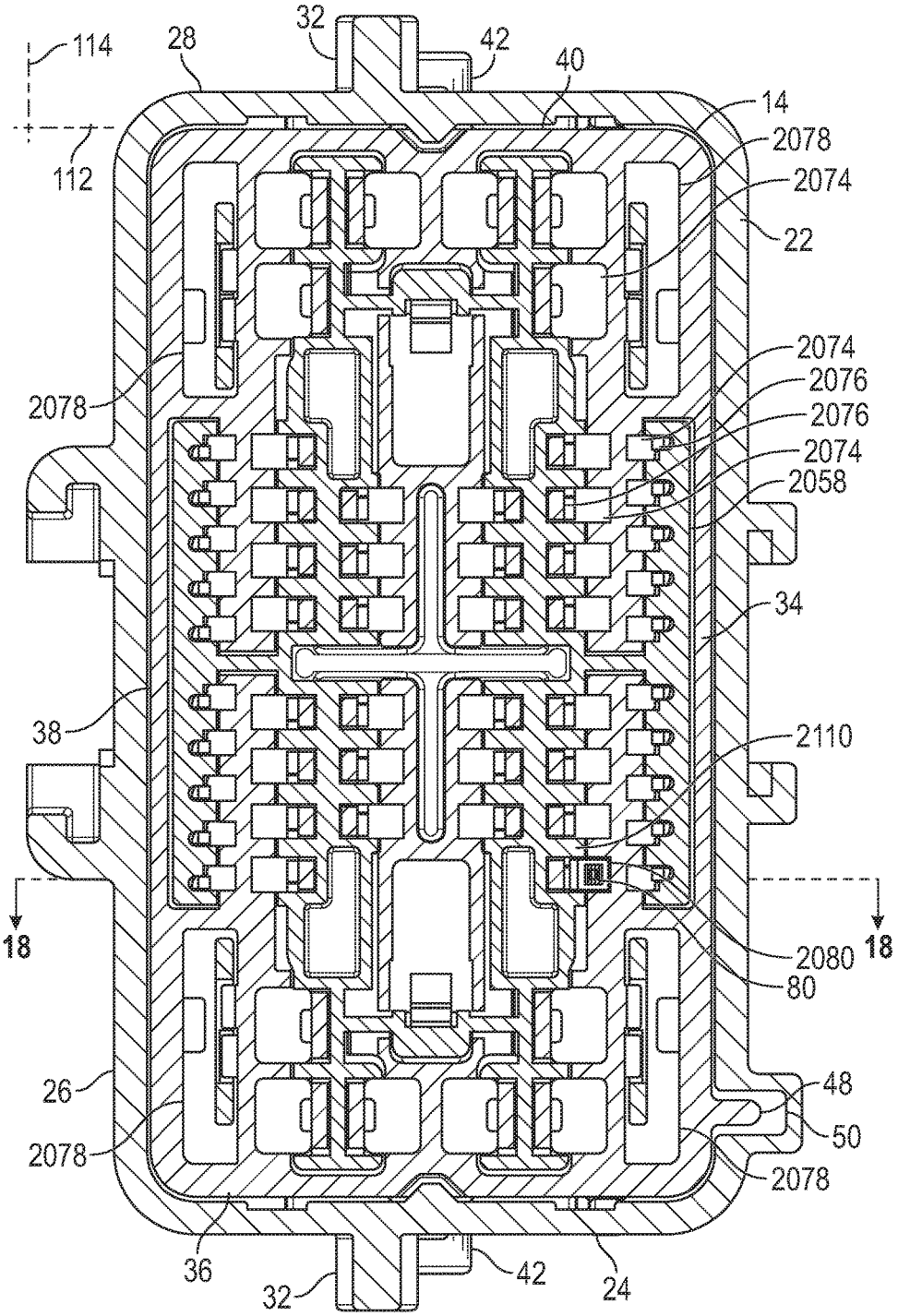
FIG. 19 is a view similar to FIG. 16, showing the first housing and the second housing in their seated position.

Referring to FIG. 19, a view similar to FIG. 16 is illustrated, taken along the line 19-19 of FIG. 18. As previously described, in the illustrated embodiment, the first terminal 80 is in a fixed position relative to the first terminal position assurance 58 and the second electrical terminal 2080 is in a fixed position relative to the second terminal position assurance 2058. Therefore, when the towers 56 and the guide walls 2098 cooperate to align the first terminal position assurance 58 with the second terminal position assurance 2058, they also align the first electrical terminal 80 with the second electrical terminal 2080. As a result, the alignment of the illustrated electrical connector 10 is not dependent on the precise alignment of the side walls 22, 24, 26, and 28 of the first housing 12 with the side walls 34, 36, 38, and 40 of the second housing 14. This allows for larger tolerances in the manufacture of the first housing 12 and the second housing 14, by focusing the tolerances of the first terminal position assurance 58 and the second terminal position assurance 2058.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a first housing including a plurality of first terminal slots each including a first terminal lock and a first end stop that is a part of the first housing, each first terminal slot configured to retain a first electrical terminal between the first terminal lock and the first end stop; and a first terminal position assurance including a first terminal position assurance body having a first front face and a plurality of first lock retainers that extend from the first terminal position assurance body and prevent the first terminal locks from moving to a release position, the first front face of the first terminal position assurance body being located in the same plane as the first end stops.

2. The electrical connector of claim 1, further comprising a plurality of first cut outs in the first terminal position assurance body wherein the first end stops are located in the first cut outs.

3. The electrical connector of claim 2, further comprising a plurality of extension walls on the first terminal position assurance that extend from a back face of the first terminal position assurance body.

4. The electrical connector of claim 3, further comprising a plurality of extension openings on the first housing that the extension walls on the first terminal positon assurance are located in.

5. The electrical connector of claim 1, further comprising a first electrical terminal located in one of the first terminal slots and retained between one of the first terminal locks and one of the first end stops.

6. The electrical connector of claim 5, further comprising a plurality of first cut outs in the first terminal position assurance body wherein the first end stops are located in the first cut outs.

7. The electrical connector of claim 6, further comprising a plurality of extension walls on the first terminal position assurance that extend from a back face of the first terminal position assurance body.

8. The electrical connector of claim 7, further comprising a plurality of extension openings on the first housing that the extension walls on the first terminal positon assurance are located in.

9. The electrical connector of claim 1, further comprising:

a second housing including a plurality of second terminal slots each including a second terminal lock and a second end stop that is a part of the second housing, each second terminal slot configured to retain a second electrical terminal between the second terminal lock and the second end stop; and a second terminal position assurance including a second terminal position assurance body having a second front face and a plurality of second lock retainers that extend from the second terminal position assurance body and prevent the second terminal locks from moving to a release position, the second front face of the second terminal position assurance body being located in the same plane as the second end stops;

the second housing located in a seated position relative to the first housing wherein a front face of the first terminal position assurance is engaged with a front face of the second terminal position assurance.

10. The electrical connector of claim 9, further comprising a plurality of first cut outs in the first terminal position assurance body wherein the first end stops are located in the first cut outs and a plurality of second cut outs in the second terminal position assurance body wherein the second end stops are located in the second cut outs.

11. The electrical connector of claim 10, further comprising a plurality of extension walls on the first terminal position assurance that extend from a back face of the first terminal position assurance body and a plurality of extension walls on the second terminal position assurance that extend from a back face of the second terminal position assurance body.

12. The electrical connector of claim 11, further comprising a plurality of extension openings on the first housing that the extension walls on the first terminal positon assurance are located in and a plurality of extension openings on the second housing that the extension walls on the second terminal position assurance are located in.

13. The electrical connector of claim 9, further comprising a first electrical terminal located in one of the first terminal slots and retained between one of the first terminal locks and one of the first end stops and a second electrical terminal located in one of the second terminal slots and retained between one of the second terminal locks and one of the second end stops, wherein the first electrical terminal is mated with the second electrical terminal.

14. The electrical connector of claim 13, further comprising a plurality of first cut outs in the first terminal position assurance body wherein the first end stops are located in the first cut outs and a plurality of second cut outs in the second terminal position assurance body wherein the second end stops are located in the second cut outs.

15. The electrical connector of claim 14, further comprising a plurality of extension walls on the first terminal position assurance that extend from a back face of the first terminal position assurance body and a plurality of extension walls on the second terminal position assurance that extend from a back face of the second terminal position assurance body.

16. The electrical connector of claim 15, further comprising a plurality of extension openings on the first housing that the extension walls on the first terminal positon assurance are located in and a plurality of extension openings on the second housing that the extension walls on the second terminal position assurance are located in.

17. An electrical connector comprising:

a first housing including a plurality of first terminal slots each including a first terminal lock and a first end stop that is a part of the first housing, each first terminal slot configured to retain a first electrical terminal between the first terminal lock and the first end stop;

a first terminal position assurance including a first terminal position assurance body having a first front face and a plurality of first lock retainers that extend from the first terminal position assurance body and prevent the first terminal locks from moving to a release position, the first front face of the first terminal position assurance body being located in the same plane as the first end stops;

a second housing including a plurality of second terminal slots each including a second terminal lock and a second end stop that is a part of the second housing, each second terminal slot configured to retain a second electrical terminal between the second terminal lock and the second end stop; and a second terminal position assurance including a second terminal position assurance body having a second front face and a plurality of second lock retainers that extend from the second terminal position assurance body and prevent the second terminal locks from moving to a release position, the second front face of the second terminal position assurance body being located in the same plane as the second end stops;

the second housing located in a seated position relative to the first housing wherein the first front face of the first terminal position assurance is engaged with the second front face of the second terminal position assurance.

18. An electrical connector comprising:

a first housing including a plurality of first terminal slots each including a first terminal lock and a first end stop that is a part of the first housing, each first terminal slot configured to retain a first electrical terminal between the first terminal lock and the first end stop;

a first terminal position assurance including a first terminal position assurance body and a plurality of first lock retainers that extend from the first terminal position assurance body and prevent the first terminal locks from moving to a release position, the first terminal position assurance body including a plurality of first cut outs wherein the first end stops are located in the first cut outs;

a second housing including a plurality of second terminal slots each including a second terminal lock and a second end stop that is a part of the second housing, each second terminal slot configured to retain a second electrical terminal between the second terminal lock and the second end stop; and a second terminal position assurance including a second terminal position assurance body and a plurality of second lock retainers that extend from the second terminal position assurance body and prevent the second terminal locks from moving to a release position, the second terminal position assurance body including a plurality of second cut outs wherein the second end stops are located in the second cut outs;

the second housing located in a seated position relative to the first housing wherein a front face of the first terminal position assurance is engaged with a front face of the second terminal position assurance.

* * * * *